US007870715B2

(12) United States Patent
Fukuda

(10) Patent No.: US 7,870,715 B2
(45) Date of Patent: Jan. 18, 2011

(54) STEEL CORD

(75) Inventor: Yukimasa Fukuda, Kodaira (JP)

(73) Assignee: Bridgestone Corporation, Tokyo (JP)

( * ) Notice: Subject to any disclaimer, the term of this patent is extended or adjusted under 35 U.S.C. 154(b) by 138 days.

(21) Appl. No.: 12/438,884

(22) PCT Filed: Aug. 31, 2006

(86) PCT No.: PCT/JP2006/317181

§ 371 (c)(1),
(2), (4) Date: Feb. 25, 2009

(87) PCT Pub. No.: WO2008/026272

PCT Pub. Date: Mar. 6, 2008

(65) Prior Publication Data

US 2010/0005774 A1 Jan. 14, 2010

(51) Int. Cl.
*D02G 3/48* (2006.01)

(52) U.S. Cl. ..... 57/213

(58) Field of Classification Search ..... 57/212, 57/213, 217, 223, 232; 152/451, 527, 556
See application file for complete search history.

(56) References Cited

U.S. PATENT DOCUMENTS

| | | | | |
|---|---|---|---|---|
| 4,609,024 | A * | 9/1986 | Yatsunami et al. | 152/527 |
| 5,802,829 | A * | 9/1998 | Yamanaka | 57/212 |
| 6,182,433 | B1 * | 2/2001 | Tagawa | 57/212 |
| 6,354,068 | B1 * | 3/2002 | Onuma et al. | 57/212 |
| 6,425,428 | B1 * | 7/2002 | Onuma et al. | 152/527 |
| 6,748,731 | B2 * | 6/2004 | Kobayashi et al. | 57/212 |
| 2008/0066844 | A1 * | 3/2008 | Obana | 152/451 |

FOREIGN PATENT DOCUMENTS

| | | | |
|---|---|---|---|
| JP | 08-325962 | A | 12/1996 |
| JP | 2000-073285 | A | 3/2000 |
| JP | 2000-096466 | A | 4/2000 |
| JP | 2000-280708 | A | 10/2000 |
| JP | 2002-180387 | A | 6/2002 |

* cited by examiner

*Primary Examiner*—Shaun R Hurley
(74) *Attorney, Agent, or Firm*—Sughrue Mion, PLLC

(57) ABSTRACT

There is provided a steel cord including a plurality of untwisted core filaments of steel aligned in parallel, and a layer of sheath filaments of steel twisted around the core filaments so as to be unevenly distributed around the core filaments, wherein interstices between the filaments are maintained during vulcanization thereby achieving improved rubber penetration (sufficiently adhering rubber to the core filaments). Since the cross sectional length of the steel cord 10 is greater than the minimum cross sectional length, interstices A are maintained between sheath filaments 14 under the tension and pressure p of the surrounding rubber 16 applied to the steel cord 10 during vulcanization. Rubber 16 penetrates into the steel cord 10 through the interstices A, and sufficiently adhere to core filaments 12 to achieve high rubber penetration.

4 Claims, 2 Drawing Sheets

STEEL CORD

TECHNICAL FIELD

The present invention relates to a steel cord, including a plurality of untwisted core filaments of steel aligned in parallel, and a layer of sheath filaments of steel twisted around the core filaments so as to be unevenly distributed around the core filaments.

BACKGROUND ART

Steel cords for reinforcing rubber articles such as pneumatic tires have a variety of twisting structures. In order to achieve so-called rubber penetration (easiness of penetration of rubber between filaments during rubber coating), usually, the form of filaments is enlarged thereby providing adequate interstices between filaments, or sheath filaments are arranged around core filaments in a number slightly smaller than the maximum allowable number thereby providing adequate interstices.

Specifically, for example, Patent Document 1 discloses a steel cord including core filaments composed of a plurality of core wires aligned on the same level, and a plurality of side wires twisted around the core filaments so as to form a flat cross section, wherein interstices are provided between the core and side wires at the ends of the steel cord in the width direction.

Patent Document 1: Japanese Unexamined Patent Application Publication No. 2002-180387

DISCLOSURE OF INVENTION

Problems to be Solved by the Invention

However, in a steel cord composed of core filaments and sheath filaments twisted around the core filaments not at regular intervals but in an unevenly distributed state, the untwisted core filaments aligned in parallel are pulled so as to be slightly undulated by the twisting tension of the sheath filaments. As a result of this, the core filaments are brought into contact with the sheath filaments on the inside of the bending portion (compressed side).

In particular, in twisted portions wherein core filaments aligned in parallel in one direction are covered by sheath filaments in a direction generally perpendicular to the aligning direction, even if the filaments are coated with rubber, the filaments are brought into contact with each other to have no interstices between them by the tension applied during vulcanization and the pressure of the surrounding rubber, which results in the formation of closed spaces containing no rubber (not penetrated by rubber) within the cord.

The present invention has been made to solve the above problems, and is intended to provide a steel cord including a plurality of untwisted core filaments of steel aligned in parallel, and a layer of sheath filaments of steel twisted around the core filaments so as to be unevenly distributed around the core filaments, wherein interstices between the filaments are maintained during vulcanization thereby achieving improved rubber penetration (sufficiently attaching rubber to the core filaments).

Means for Solving the Problem

In a steel cord including a plurality of untwisted core filaments of steel aligned in parallel, and a layer of sheath filaments of steel twisted around the core filaments so as to be unevenly distributed around the core filaments, in order to achieve good rubber penetration into the twisted portions wherein the core filaments aligned in parallel in one direction are covered by sheath filaments in a direction generally perpendicular to the aligning direction, interstices must be maintained between the sheath filaments in the portions. In order to achieve this, the sheath filaments at both ends in the aligning direction must be arranged with adequate clearance around them in the maximum width direction of the steel cord (but the sheath filaments may be in contact with the core filaments). In the present description, the sectional length $\phi$ of the cord in a cross section shown in FIG. 2 is hereinafter referred to as "cross sectional length".

The steel cord of the present invention includes two untwisted core filaments, each having a diameter of $d_c$, aligned in parallel, and a layer composed of four sheath filaments, each having a diameter of $d_s$, twisted around the core filaments so as to be unevenly distributed around the core filaments, the cross sectional length $\phi$ in the aligning direction of the core filaments satisfying the following formula (1):

$$\phi > 2d_s + \frac{2d_s^2(d_c - d_s) + 4d_c d_s\sqrt{d_s(2d_s + d_c)}}{(d_c + d_s)^2} \quad (1)$$

The right-hand side of the formula (1) expresses the cross sectional length of the steel cord wherein the filaments are arranged in close contact with each other. The right-hand side is referred to as "minimum cross sectional length".

In the steel cord of the present invention, the cross sectional length $\phi$ is greater than the minimum cross sectional length expressed by the right-hand side of the formula (1), hence interstices are maintained between sheath filaments under the tension and pressure of the surrounding rubber applied during rubber coating and vulcanization of the steel cord, and the rubber penetrates through the interstices to sufficiently adhere to the core filaments. Consequently, the steel cord of the present invention achieves good rubber penetration.

The upper limit of the cross sectional length $\phi$ is $2d_s+2d_c$, which is the sum of the diameters of two core filaments and two sheath filaments at the both ends aligned in contact with each other.

In the present invention, the cross sectional length $\phi$ is preferably not smaller than the right-hand side of the formula (1)+0.01 mm, and the diameter $d_s$ of a sheath filament and the diameter $d_c$ of a core filament are preferably from 0.10 to 0.40 mm.

Advantages

As described above, the steel cord of the present invention includes a plurality of untwisted core filaments of steel aligned in parallel, and a layer of sheath filaments of steel twisted around the core filaments so as to be unevenly distributed around the core filaments. The steel cord achieves markedly improved rubber penetration (sufficiently adhering rubber to the core filaments) through the maintenance of interstices between filaments during vulcanization.

REFERENCE NUMERALS

10 steel cord
12 core filaments
14 sheath filaments

BEST MODE FOR CARRYING OUT THE INVENTION

Figure 1:
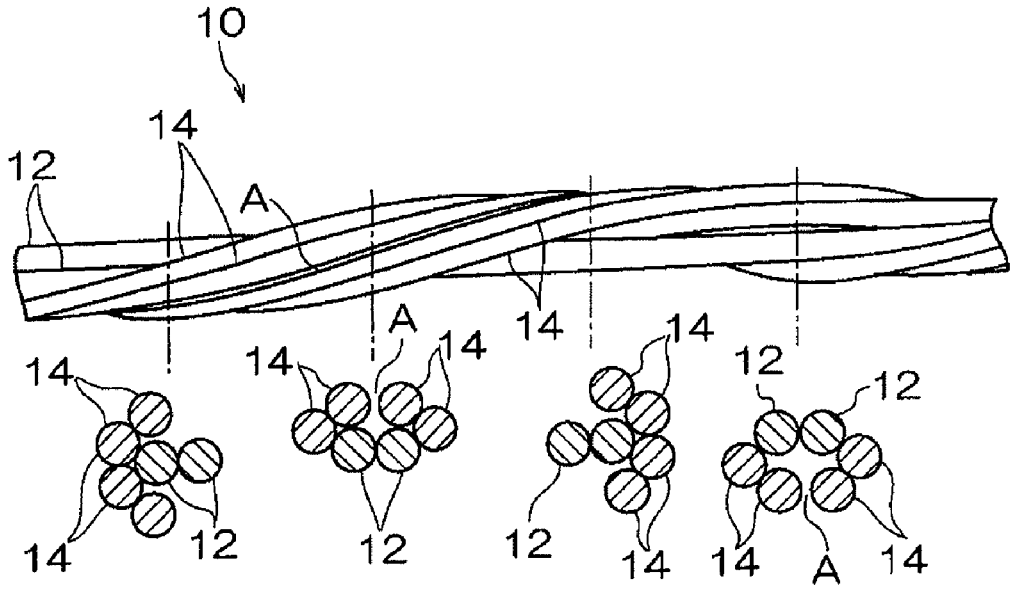
FIG. 1 shows a plane view of a steel cord and cross sectional views of respective portions of the steel cord.
Figure 2:
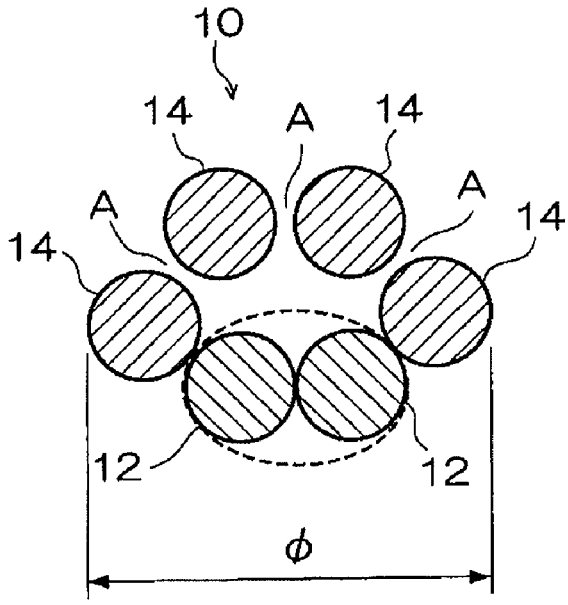
FIG. 2 shows a cross sectional view of a steel cord.

An embodiment of the present invention will be described on the basis of drawings. As shown in FIGS. 1 and 2, a steel cord 10 according to an embodiment of the present invention includes two untwisted core filaments 12, each having a diameter of $d_c$ (mm), aligned in parallel, and a layer composed of four sheath filaments 14, each having a diameter of $d_s$ (mm), twisted around the core filaments 12 so as to be unevenly distributed around the core filaments 12, the cross sectional length $\phi$ satisfying the following formula (1):

$$\phi > 2d_s + \frac{2d_s^2(d_c - d_s) + 4d_c d_s\sqrt{d_s(2d_s + d_c)}}{(d_c + d_s)^2} \quad (1)$$

As described above, the right-hand side of the formula (1) expresses the minimum cross sectional length of the cord wherein the filaments are arranged in close contact with each other. Therefore, when the cross sectional length $\phi$ is greater than the minimum cross sectional length, interstices A can be formed between the sheath filaments 14. In order to achieve rubber penetration more reliably, the cross sectional length $\phi$ is preferably greater than the minimum cross sectional length by 0.01 mm or more.

As described above, the upper limit of the cross sectional length $\phi$ is $2d_s+2d_c$, which is the sum of the diameters of two core filaments 12 and two sheath filaments 14 at the ends aligned in contact with each other.

When the steel cord 10 of the present invention is used for reinforcing a tire, the diameter of the core filaments 12 and sheath filaments 14 is preferably from 0.10 to 0.40 mm. If the filament diameter is too small, the filaments are disadvantageous costwise, and if too large, they have a low strength per unit weight due to insufficient work-hardening, and have too high flexural rigidity to lack flexibility, and exhibit poor fatigue resistance against bending strain.

When the core filaments 12 and sheath filaments 14 have the same diameter, they offer a cost advantage. In this case, a layer of up to eight sheath filaments 14 can be twisted around the two core filaments 12 arranged in parallel with each other. The rubber penetration is improved by removing four sheath filaments 14, which results in sufficient adherence of rubber 16 (FIG. 3) to the core filaments 12 after vulcanization.

(Operation)

Figure 3:
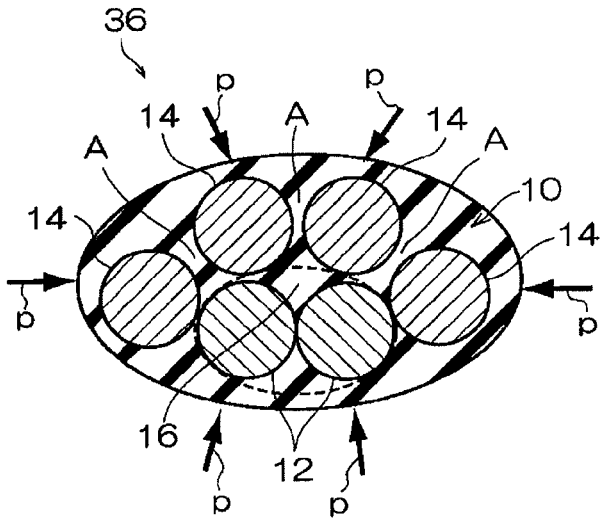
FIG. 3 shows a cross sectional view of a ribbon composed of steel cords coated with vulcanized rubber.

As shown in FIG. 3, in the steel cord 10, interstices A are maintained between the sheath filaments 14, and the interstices A will not be lost even under the tension and pressure p of the surrounding rubber 16 applied to the steel cord 10 during vulcanization. Therefore, the rubber 16 penetrates into the steel cord 10 through the interstices A, and adheres to the core filaments 12.

As described above, the steel cord 10 of the present invention achieves good rubber penetration with a structure including the sheath filaments 14 twisted around the core filaments 12 so as to be unevenly distributed around the core filaments 12. The use of the steel cord 10 allows the manufacture of rubber articles such as a ribbon 36 with sufficient rubber penetration.

The ribbon 36, which is composed of the steel cord 10 of the present invention embedded in rubber, is useful for, for example, making a belt-reinforcing layer of a tire (not shown). A belt-reinforcing layer including the ribbon 36 is resistant to entry of moisture into the layer, specifically into the steel cord, even if a tread (not shown) is cut, and thus offers better corrosion resistance.

(Method and Apparatus for Producing Steel Cord)

Figure 4:
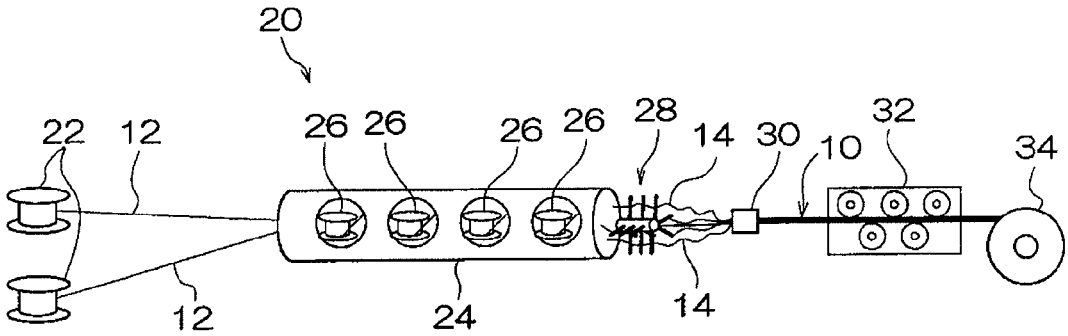
FIG. 4 shows a schematic view of a tubular strander.

The steel cord 10 of the present invention may be produced with, for example, a tubular strander 20 shown in FIG. 4. In the tubular strander 20, the core filaments 12 are reeled out from a plurality of core filament bobbins 22, the sheath filaments 14 are reeled out from a plurality of sheath filament bobbins 26, which are contained in a rotary barrel 24, and formed by a preformer 28, and then the core filaments 12 and the sheath filaments 14 are assembled at the junction 30 to be twisted together. The twisted steel cord 10 is passed between the straightening rolls 32, and wound around, for example, a reel 34. In the tubular strander 20, an appropriate tension is applied to the core filaments 12 reeled out from the core filament bobbins 22.

In the tubular strander 20, the sheath filaments 14 reeled out from the rotary barrel 24 are formed by the preformer 28 and sent to the junction 30, at the same time, the core filaments 12 reeled out from the core filament bobbins 22 outside the rotary barrel 24 are aligned in parallel in an untwisted state without being subjected to forming, and then sent to the center of the junction 30.

Since the rotary barrel 24 is rotating, the sheath filaments 14 are twisted around the core filaments 12 at the junction 30 to form the steel cord 10. The twisted steel cord 10 is straightened by the straightening rolls 32, and wound around the reel 34.

The cross sectional length $\phi$ of the steel cord 10 is controlled by changing the tension applied to the core filaments 12 before twisting, and changing the degree of bending of the steel cord 10 through the control of the engagement between the upper and lower rolls of the straightening rolls 32.

Specifically, for example, when the tension applied to the core filaments 12 is decreased and the degree of bending of the steel cord 10 at the straightening rolls 32 is increased, the steel cord 10 tends to be rounded (the cross sectional length $\phi$ decreases) in the twisted portions wherein the core filaments 12 aligned in one direction are covered by the sheath filaments 14 in a direction generally perpendicular to the aligning direction.

The aligning direction is the direction along which the core filaments 12 are aligned. For example, in FIG. 2, the lateral direction corresponds to the aligning direction. The aligning direction of the core filaments 12 is not limited to the lateral direction.

EXAMPLES

The present invention will be illustrated with reference to the following examples.

The steel cords of Examples and Comparative Examples listed in Table 1 were concurrently embedded in a periphery of a belt layer (the first belt layer located at the innermost part in the tire diameter direction) in a prototype tire having a tire size of 185/70R14 and two belt-reinforcing layers. The steel cords were removed from the tire after vulcanization, and the degree of adherence of the surface rubber to the core filaments after removal of the sheath filaments was observed thereby evaluating the rubber penetration. Regarding Comparative Examples 1 and 2, the measured value of the cross sectional length $\phi$ was smaller than the minimum cross sectional length (calculated value).

The evaluation of the rubber penetration rate is exclusively based on the observation of cross sections of ten twisted portions wherein core filaments aligned in parallel in one direction are covered by sheath filaments in a direction generally perpendicular to the aligning direction, and is expressed by the ratio (percentage) of cross sections which achieved rubber penetration. The results are listed in Table 1.

TABLE 1

| | Example 1 | Example 2 | Comparative Example 1 | Example 3 | Comparative Example 2 |
|---|---|---|---|---|---|
| Twisted structure | 2 + 4 | 2 + 4 | 2 + 4 | 2 + 4 | 2 + 4 |
| Core filament diameter $d_c$ (mm) | 0.225 | 0.225 | 0.225 | 0.23 | 0.23 |
| Sheath filament diameter $d_s$ (mm) | 0.225 | 0.225 | 0.225 | 0.21 | 0.21 |
| Twisting pitch (mm) | 14 | 14 | 14 | 14 | 14 |
| Minimum cross sectional length Calculated value of the right-hand side of the formula (1) | 0.840 | 0.840 | 0.840 | 0.798 | 0.798 |
| Measured value of cross sectional length $\phi$ (mm) | 0.854 | 0.844 | 0.831 | 0.814 | 0.785 |
| Rubber penetration rate (%) | 90 | 50 | 30 | 80 | 30 |

As is evident from the results in Table 1, the measured value of the cross sectional length $\phi$ of Comparative Examples 1 and 2 was smaller than the minimum cross sectional length (calculated value), so that their rubber penetration rate was as low as 30%. On the other hand, the measured value of the cross sectional length $\phi$ of Examples 1 to 3 was greater than the minimum cross sectional length (calculated value), so that their rubber penetration rate was greater than that of Comparative Examples. In particular, the measured value of the cross sectional length $\phi$ of Examples 1 and 3 was greater than the minimum cross sectional length (calculated value) by 0.01 mm or more, so that their rubber penetration rate was markedly high.

The invention claimed is:

1. A steel cord comprising two untwisted core filaments, each having a diameter of $d_c$, aligned in parallel, and a layer composed of four sheath filaments, each having a diameter of $d_s$, twisted around the core filaments so as to be unevenly distributed around the core filaments, the cross sectional length $\phi$ satisfying the following formula (I):

$$\phi > 2d_s + \frac{2d_s^2(d_c - d_s) + 4d_c d_s\sqrt{d_s(2d_s + d_c)}}{(d_c + d_s)^2}. \quad (1)$$

2. The steel cord according to claim 1, wherein the cross sectional length $\phi$ is not smaller than the right-hand side of the formula (1)+0.01 mm.

3. The steel cord according to claim 1, wherein $d_s$ and $d_c$ are from 0.10 to 0.40 mm.

4. The steel cord according to claim 2, wherein $d_s$ and $d_c$ are from 0.10 to 0.40 mm.

* * * * *